US008926129B2

(12) United States Patent
Socarras

(10) Patent No.: US 8,926,129 B2
(45) Date of Patent: Jan. 6, 2015

(54) LED LIGHTING SYSTEM

(76) Inventor: Tito Socarras, Miramar, FL (US)

( * ) Notice: Subject to any disclaimer, the term of this patent is extended or adjusted under 35 U.S.C. 154(b) by 440 days.

(21) Appl. No.: 13/082,202

(22) Filed: Apr. 7, 2011

(65) Prior Publication Data

US 2011/0249440 A1 Oct. 13, 2011

Related U.S. Application Data

(60) Provisional application No. 61/322,080, filed on Apr. 8, 2010.

(51) Int. Cl.

| | |
|---|---|
| ***F21V 29/00*** | (2006.01) |
| ***F21K 99/00*** | (2010.01) |
| ***F21S 4/00*** | (2006.01) |
| ***F21V 21/30*** | (2006.01) |
| ***H01R 33/02*** | (2006.01) |
| *F21Y 101/02* | (2006.01) |
| *F21Y 103/00* | (2006.01) |

(52) U.S. Cl.

CPC . *F21K 9/00* (2013.01); *F21S 4/008* (2013.01); *F21V 21/30* (2013.01); *F21V 29/225* (2013.01); *H01R 33/02* (2013.01); *F21K 9/17* (2013.01); *F21Y 2101/02* (2013.01); *F21Y 2103/003* (2013.01)

USPC ..... 362/249.02

(58) Field of Classification Search

USPC ..... 362/249.02

See application file for complete search history.

(56) References Cited

U.S. PATENT DOCUMENTS

| | | | | |
|---|---|---|---|---|
| 6,583,550 | B2 | 6/2003 | Iwasa et al. | |
| 6,860,628 | B2 | 3/2005 | Robertson et al. | |
| 6,936,968 | B2 | 8/2005 | Cross et al. | |
| 6,997,576 | B1 | 2/2006 | Lodhie et al. | |
| 7,192,161 | B1 | 3/2007 | Cleaver et al. | |
| 7,441,922 | B2 | 10/2008 | Huang et al. | |
| 7,476,004 | B2 | 1/2009 | Chan | |
| 7,478,924 | B2 | 1/2009 | Robertson | |
| 7,635,201 | B2 | 12/2009 | Deng | |
| 2008/0151535 | A1 | 6/2008 | de Castris | |
| 2009/0027916 | A1 | 1/2009 | Huang et al. | |
| 2009/0091929 | A1 | 4/2009 | Faubion | |
| 2009/0185374 | A1* | 7/2009 | Wu et al. | 362/249.06 |
| 2009/0290334 | A1 | 11/2009 | Ivey et al. | |
| 2009/0303720 | A1 | 12/2009 | McGrath | |
| 2010/0008085 | A1 | 1/2010 | Ivey et al. | |
| 2010/0027259 | A1 | 2/2010 | Simon et al. | |
| 2010/0033964 | A1 | 2/2010 | Choi et al. | |

* cited by examiner

*Primary Examiner* — Anh Mai
*Assistant Examiner* — Brenitra M Lee
(74) *Attorney, Agent, or Firm* — Lott & Fischer, PL

(57) ABSTRACT

An LED lighting system comprising a housing, a divider, one or more LED strips including one or more light emitting diodes, and one or more end caps having at least one electrical terminal. The divider is disposed in the housing, the one or more LED strips is disposed on the divider; and the electrical terminal of the end caps is in electrical contact with the LED strips. In some embodiments, the end caps are adapted to engage a light socket, wherein the electrical terminal of the end caps is disposed between and in electrical contact with the LED strips and the light socket, and the light socket is in electrical contact with an electrical power source. In some embodiments, the electrical terminal defines a spring engagement between the end caps and the light socket, permitting the lighting system to rotate with respect to the light socket.

16 Claims, 6 Drawing Sheets

LED LIGHTING SYSTEM

PRIORITY INFORMATION

This application claims the benefit of U.S. Provisional Application No. 61/322,080, filed Apr. 8, 2010.

BACKGROUND OF THE INVENTION

High-output fluorescent lighting systems, commonly used in sign applications, are known to have extremely high power requirements and heat output. Such high-output systems are also not particularly reliable, nor are they environmentally friendly due to the gases that are used in fluorescent bulbs. However, light-emitting diodes (or "LEDs") generally have lower power requirements, increased lamp life, service life, and reliability and lower overall environmental impact. Accordingly, the present invention provides an LED lighting system that is a direct replacement for high-output fluorescent lighting systems known in the art while maintaining the same high-output light emission characteristics of such systems.

SUMMARY OF THE INVENTION

The present invention relates generally to lighting systems and more specifically to various embodiments of a light-emitting diode (hereinafter referred to as "LED") lighting system including a lamp, end caps, and power supply. The present invention comprises an improved LED lighting system designed to be used in connection with a wide variety of applications, including custom signs and to retrofit existing signs. The present invention offers high efficiency, low heat-emission lighting that is 100% recyclable, features that are not possible with common high output fluorescent light systems.

In some embodiments, the LED lighting system of present invention comprises a housing, a divider, one or more LED strips including one or more light emitting diodes, and one or more end caps having at least one electrical terminal. The divider is disposed in the housing, the one or more LED strips is disposed on the divider; and the electrical terminal of the end caps is in electrical contact with the LED strips. In some embodiments, the end caps are adapted to engage a light socket, wherein the electrical terminal of the end caps is disposed between and in electrical contact with the LED strips and the light socket, and the light socket is in electrical contact with an electrical power source. In some embodiments, the electrical terminal defines a spring engagement between the end caps and the light socket, permitting the lighting system to rotate with respect to the light socket In some embodiments, the divider is comprised of aluminum and is substantially rectangular, defining a first side and a second side. Accordingly, one or more LED strips may be disposed on either side of the divider. In some embodiments, the divider has an I-beam shaped cross section, defining a channel along each side of the divider, wherein the LED strips may be disposed in the channels. Further, the divider may include one or more fins longitudinally disposed along a length thereof. Further still, in some embodiments the housing is translucent and substantially cylindrical (i.e. tubular).

Further still, the LED lighting system of the present invention comprises a housing, a divider having one or more light emitting diodes thereon, one or more end caps having at least one electrical terminal, wherein the divider is disposed in the housing; and wherein the electrical terminal of the end caps is in electrical contact with the light emitting diodes.

Accordingly, it is an object of the present invention provide an LED lighting system with high output and relatively low power requirements and drastically reduced heat emission and noise. It is a further object of the present invention to provide an LED lamp that has 360-degree light emission in order to permit optimal light dispersal for a variety of applications. It is a further object of the present invention to provide a lighting system for industrial and commercial applications with drastically improved efficiency, service life, and reliability. It is yet a further object of the present invention to provide an LED lighting system that is a direct replacement for high-output fluorescent lighting systems known in the art, wherein the LED lighting system is compatible with the same high-output sockets used in these systems. It is yet a further object of the present invention to provide a lighting system that incorporates end caps that permit 360-degree rotation of the lighting system with respect to its socket, in order to provide improved reliability and modularity. These and other objects of the present invention will become readily apparent in the following description.

DETAILED DESCRIPTION OF THE INVENTION

Figure 1:
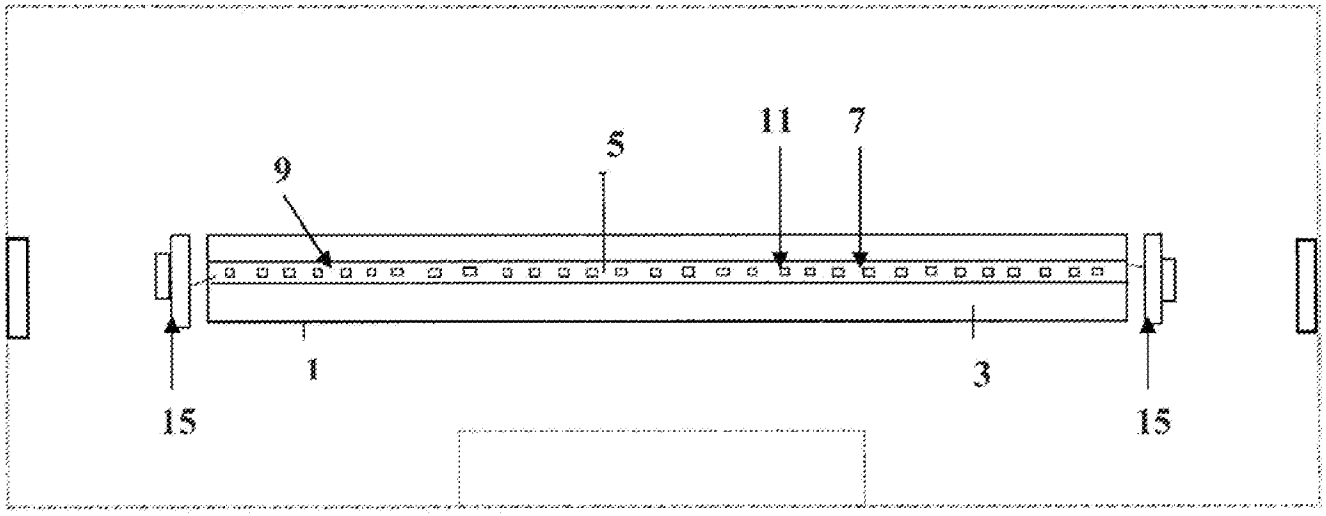
FIG. 1 is a schematic of one embodiment of the LED lighting system of the present invention
Figure 6:
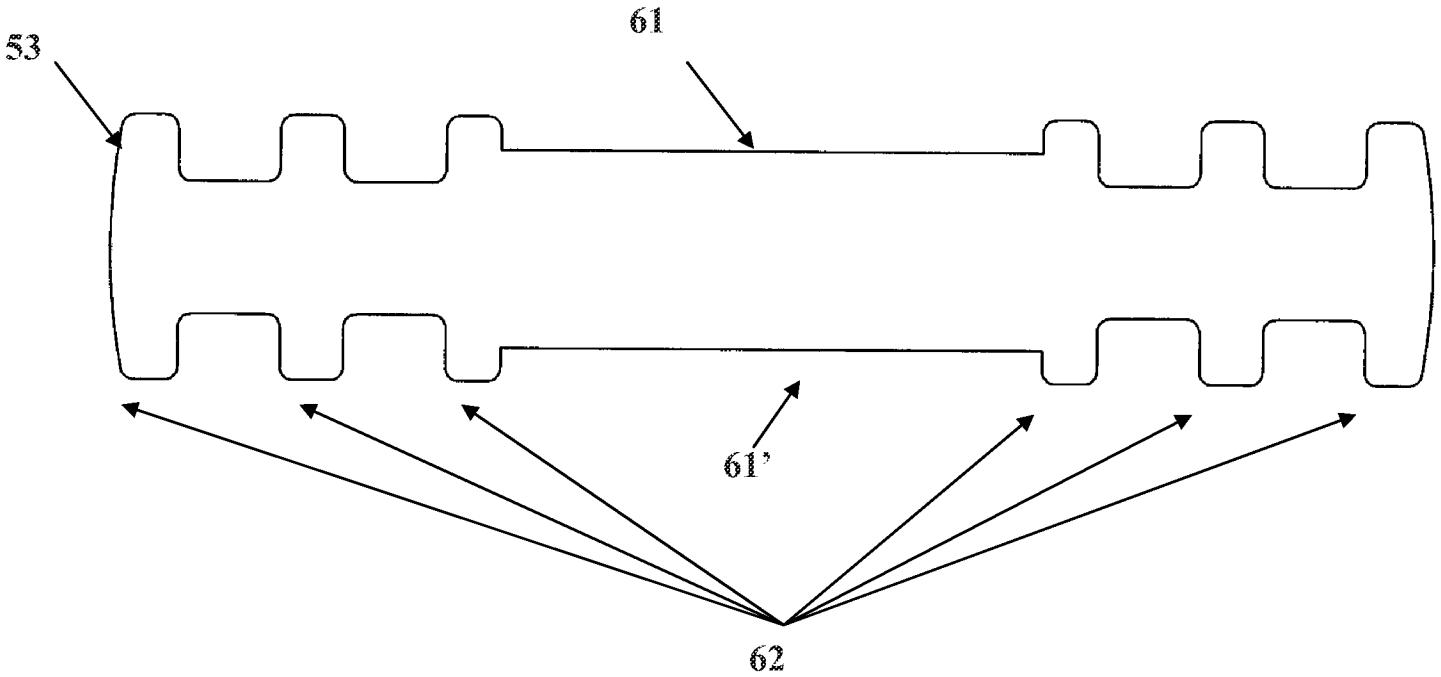
FIG. 6 is a cross-sectional view of an embodiment of a divider/heat sink component of the present invention.

With reference to FIG. 1, one embodiment of the lighting system of the present invention comprises a hollow housing 1 having a LED divider 3 disposed therein. In some embodiments, divider 3 may be rectangular; however other shapes and configurations may be equally suitable. In some embodiments, the divider 3 is comprised of a transparent or translucent material such as polycarbonate (i.e. Lexan®), or another suitable plastic or synthetic material. The housing materially may be made of a flexible and inexpensive material as desired. The use of a transparent or translucent divider 3 provides substantial advantages over the prior art in that, where the strip is disposed on both sides thereof, the present invention provides for substantially omni-directional light emission. That being said, divider 3 may optionally be comprised of an opaque material, which provides for more directional lighting. Accordingly, divider 3 may be comprised of a metal, such as aluminum, which includes heat dissipation characteristics, as shown in FIG. 6 and discussed below.

In some embodiments, the housing 1 may be cylindrical (i.e. tubular) in shape and the divider may be a substantially planar rectangular; however other shapes and sizes may be equally suitable depending on the desired installation. Additionally, it may be preferred that the height of divider 3 be substantially equal to the diameter of housing 1 to assure that divider remains in place during installation and use. Depending on the desired application, the present invention vary in length from 18" up to 120". Although the lamp of the present invention is designed to have relatively low heat dissipation, it may be desired to place apertures along housing 1 in order to allow ambient or forced airflow through the lamp as desired for a particular application. Alternatively, divider 3 may be configured to have a plurality of fins such that it functions as its own heat sink, as shown in FIG. 6 and described in further detail below.

Mounted to divider 3 is an LED light strip 5 that contains a plurality of high output LEDs 7. In some embodiments, strip 5 comprises a ribbon 9 which may be a semi-flexible material, such that the ribbon defines a substrate or backing for the LEDs. Mounted to ribbon 9 is a plurality of LEDs 7 and resistors 11. Additionally, in some embodiments, strip 5 may have integrated circuitry such that the LEDs 7 and resistors 11 can be wired together, either in series or parallel, depending on the desired configuration and power requirements. In some embodiments, an LED light strip 5 is disposed on both planar sides of the divider, thus increasing the number and LEDs and, in turn, the resultant light emission. Further, in some embodiments, a plurality of LED light strips 5 may be mounted to either side of divider 3. In yet other embodiments, LED strip 5 may be integrated into and coextensive with divider 3, such that divider 3 defines the ribbon 9 or substrate to which LEDs 7 are mounted.

Figure 2:
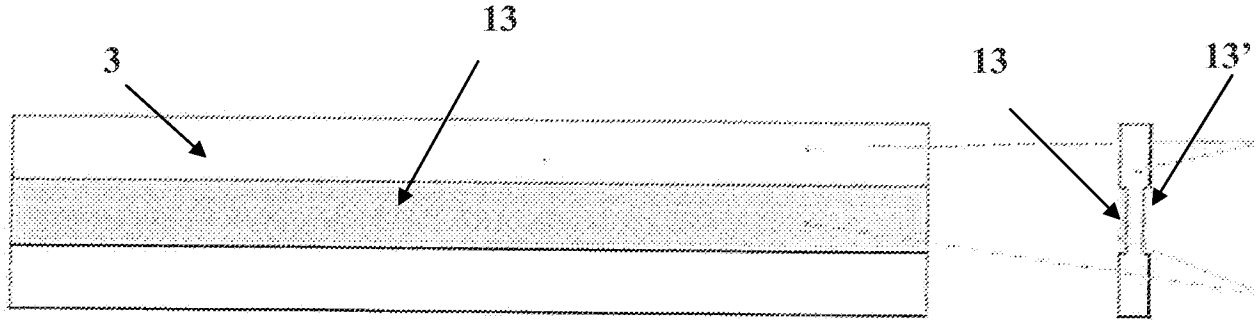
FIG. 2 is a top and cross-sectional view of one embodiment of the divider/heat sink component of the present invention.
Figure 3:
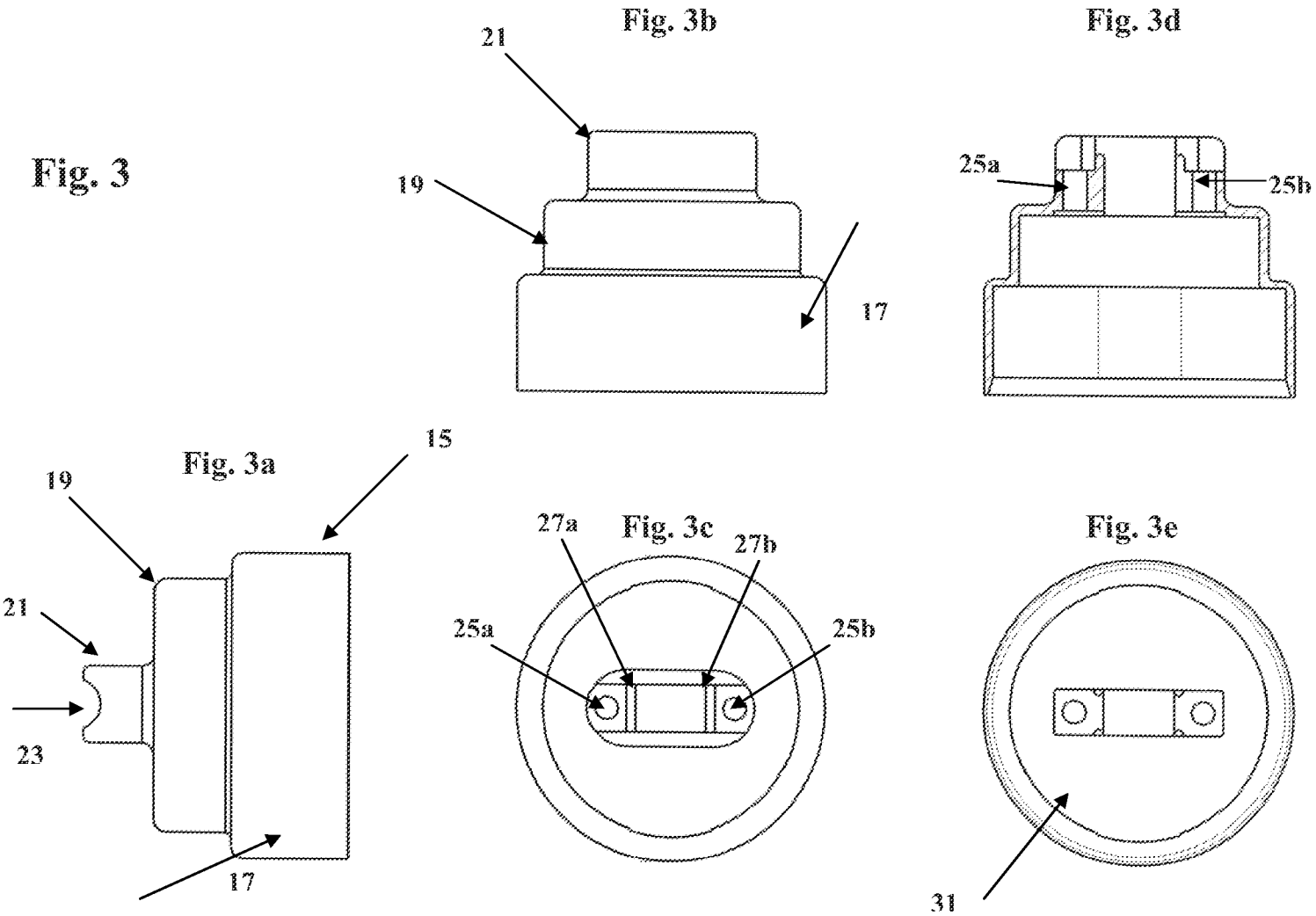
FIG. 3*a* is a side view of one embodiment of the end cap of the present invention.
FIG. 3*b* is another side view of one embodiment of the end cap of the present invention.
FIG. 3*c* is a top view of one embodiment of the end cap of the present invention.
FIG. 3*d* is a cutaway side view of one embodiment of the end cap of the present invention.
FIG. 3*e* is a bottom view of one embodiment of the end cap of the present invention.

As shown in FIG. 2, in some embodiments of the present invention, divider 3 may be made of translucent acrylic and may have an "I-beam" shaped cross-section wherein the thickness of divider 3 is slightly narrowed at the center of the cross-section. The "I-beam" shaped cross-section delimits channels 13 and 13' along the length of divider 3 such that it is adapted to receive light strips 5 on either side thereof.

In some embodiments, strip 5 may be secured to channel 13 or 13' (and therefore divider 3) by compression fit or by an adhesive material. If a compression fit is used, it may be preferable that the cross section of the divider at channel 13 is notched or lipped such that the sides of channels 13 and 13' are capable of receiving the edges of strip 5, thus securing the ribbon in the channel. The use of this type of a lipped channel allows for strip 5 to be interchanged, replaced, and/or repaired as desired without damaging divider 3.

As stated, in some embodiments, an adhesive may be used to affix strip 5 to divider 3. Such adhesives may include, but are not limited to, epoxies, cyanoacrylates, urethanes, acrylic adhesives, pressure sensitive adhesives, thermosets, and the like. Accordingly, adhesive may be affixed to the back side of strip 5 and/or to the surface of channels 13 or 13' thus joining the two together substantially permanently. In some embodiments, the surface of divider 3 along channel 13 or 13' may optionally be un-buffed such that the resulting rougher surface permits optimal adhesion of strip 5 to channel 13 or 13'.

Disposed at a first end of the housing 1 is a first end cap 15 that includes a positive electrical terminal (i.e. "+" lamp base); accordingly, disposed at the other end of the housing 1 is a second end cap 15 that includes a negative electrical terminal (i.e. "−" lamp base). The positive terminal end cap is connected to the positive terminal of the LED strip 5 and the negative terminal end cap is connected to the negative terminal of the LED strip 5. In an alternative embodiment, a single end cap may include both the positive and negative terminals and the opposing end cap is simply a "dummy" which is not in electrical contact with the LED strip 5. Accordingly, the positive and negative terminals of LED strip 5 are in electrical contact with the respective positive and negative terminals of the aforedescribed dual-terminal end cap.

In some embodiments, the two end caps are adapted to couple to existing standard fluorescent light sockets for adaptability and compatibility with common lighting systems. The size and shape of the end caps shown in the figures should not be construed as limiting as the geometry of the end caps can be modified as desired to ensure compatibility with a wide variety of light sockets known in the art, including but limited to, high-output sockets used in signs and outline lighting systems. Accordingly, the term "socket" as used in this disclosure, should also not be construed as limiting, as the lighting system of the present invention can be configured to integrate with a variety of known socket configurations.

Some embodiments of the present invention incorporate a specialized high-output end cap 15 as shown in FIGS. 3*a*-3*e* which is designed to fit new or existing high-output light sockets. In some embodiments, end cap 15 has three primary sections, a first cylindrical section 17, a second cylindrical section 19 coaxial to first section 17, and protrusion 21. In some embodiments, the first cylindrical section 17 has a larger diameter than the second cylindrical section 19 and protrusion 21 is dimensioned slightly smaller than the diameter of the second cylindrical section. Protrusion 21 has an open end 23 that is delimited by a curved cross section (where 23 points). In some embodiments, end cap 15 is a single "uni-body" structure made by known methods in the art such as extrusion or injection molding. However, in alternate embodiments, protrusion 21 may be removable. Accordingly, in one such embodiment, protrusion 21 may be mounted to or integrated with a disc-shaped base having, in some embodiments, substantially the same diameter as the second cylindrical section 19, such that the base functions as a "cap" for the remaining portion of end cap 15.

As stated, end cap 15 is designed to function as a power terminal for some embodiments the present invention. Accordingly, FIG. 3*d* is a cutaway view of the arrangement of and cap 15. Disposed within protrusion 21 are two pins 25*a* and 25*b* which are to be connected to the light socket of the given socket (not shown). In some embodiments, the pins are hollow cylinders capable of retaining the corresponding pins on the socket; in other embodiments, the pins may be solid cylinders that are capable of being connected to hollow receiving pins on the socket. As shown in FIGS. 3*c* and 3*d*, the two pins 25*a* and 25*b* are spaced equidistantly across the elongated portion of protrusion 21. In some embodiments, pins 25*a* and 25*b* are recessed with respect the top-most boundary of protrusion 21 such that the pins are not susceptible to damage or breakage during handling or storage of the present invention. Also shown in FIG. 3*c* are contacts 27*a* and 27*b* which, in some embodiments, are located to the inside of pins 25*a* and 25*b*, respectively. Contacts 27*a* and 27*b* may comprise metal "tangs" which are curved over and retained by supporting structure of end cap 15, respectively. It is understood that, for the purposes of this disclosure, the pin/contact arrangement results in an electrical terminal that is capable of receiving electrical power from a power source, as described below.

Figure 4:
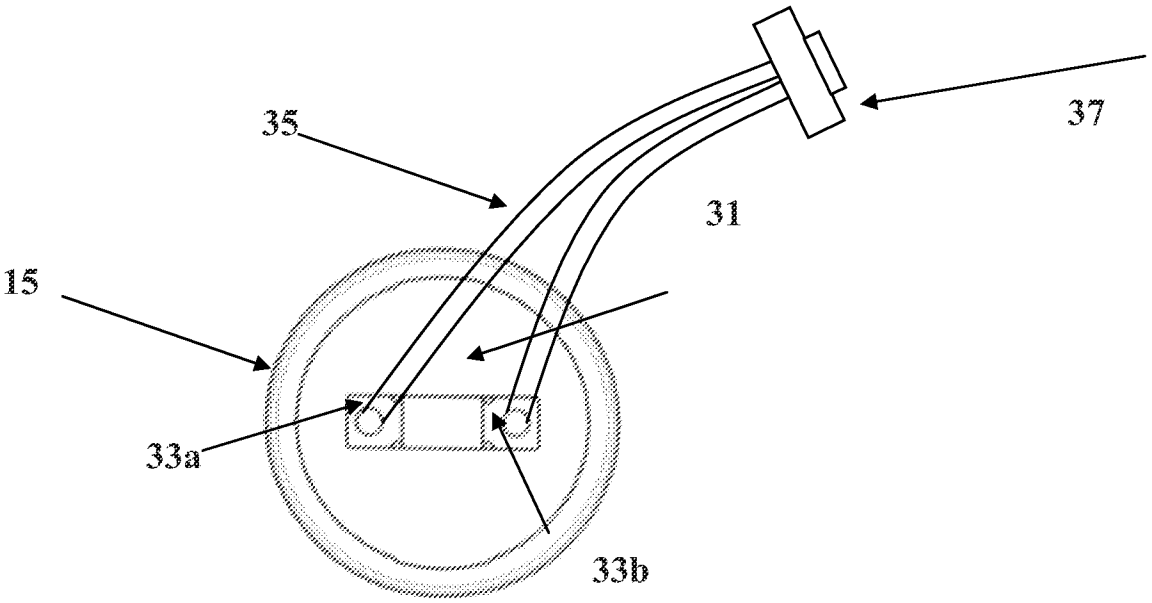
FIG. 4 is top view of the interior of one embodiment of the end cap of the present invention.

As shown in FIG. 4 some embodiments of end cap 15 may have, disposed on the inside thereof, a metal retaining cup 31 which functions as a wiring support for the present invention (also shown in FIG. 3*e*). Accordingly, cup 31 may have two apertures 33*a* and 33*b* which permit the proximal end of wiring 35 to pass through into housing 1. As such, the proximal end of wiring 35 is connected to pins 25*a* and 25*b* by soldering, crimping or other known methods. The distal end of wiring 35 may have a wiring harness 37 which is connected to and allows the transmission of power to LED strip 5 from the high-output sockets. Accordingly, LED strip 5 has a complementary wiring harness (not shown) which accordingly places end cap 15 into electrical contact with the LEDs 7.

Figure 5:
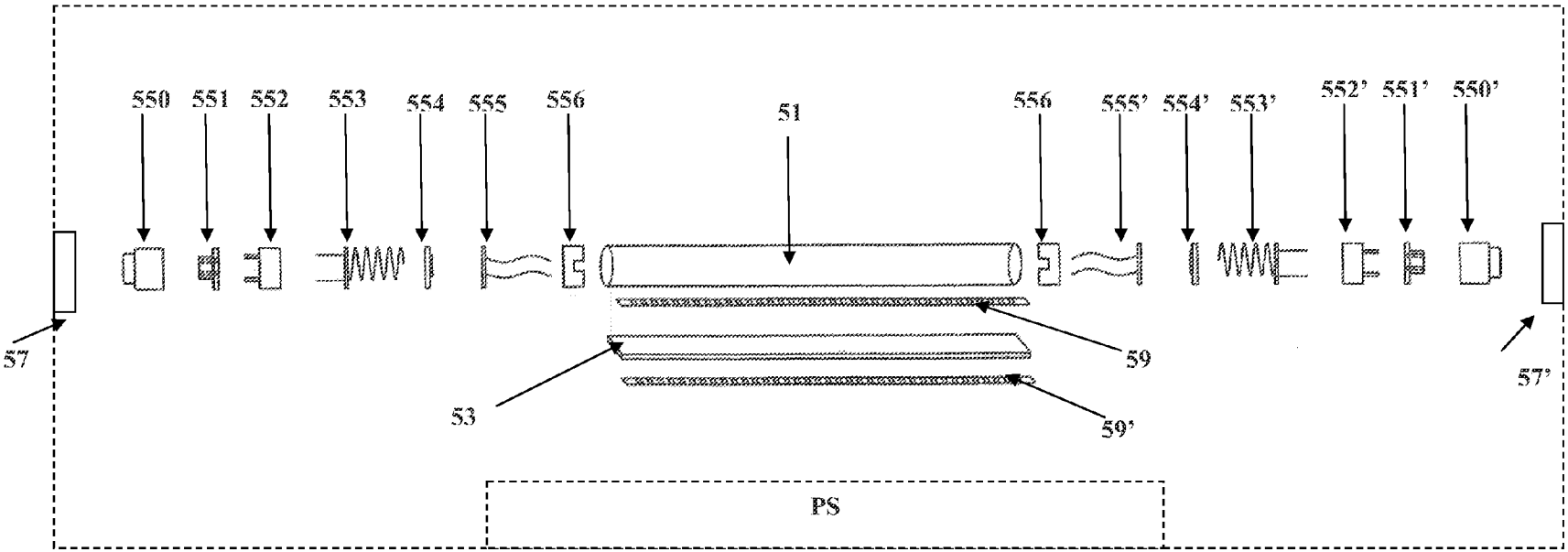
FIG. 5 is an exploded view of an embodiment of the LED lighting system of the present invention.

FIG. 5 is an exploded schematic view of another embodiment of the present invention with a modified end cap configuration that permits 360-degree rotation of the lighting system. As shown, the lamp comprises a hollow, housing 51 having a LED divider 53 disposed within housing 51. In some embodiments, divider 53 may be rectangular; however other shapes and configurations may be equally suitable. In some embodiments, the divider 53 is comprised of a transparent or translucent material such as polycarbonate (i.e. Lexan®), or another suit able plastic or synthetic material, in other embodiments, divider 53 may be comprised of an opaque material, which provides for more directional lighting. Accordingly, divider 53 may be comprised of a metal, such as aluminum, which includes heat dissipation characteristics, as shown in FIG. 6 and discussed below.

In one embodiment, the housing 51 may be cylindrical (i.e. tubular) in shape and the divider 53 may be a substantially planar rectangular; however other shapes and sizes may be equally suitable depending on the desired installation. Depending on the desired application, the present invention may vary in length from 18" up to 120". Although the lighting system of the present invention is designed to have relatively low heat dissipation, it may be desired to place apertures along housing 51 in order to allow ambient or forced airflow through the lamp as desired for a particular application. Alternatively, divider 53 may be configured to have a plurality of fins such that it functions as its own heat sink, as shown in FIG. 6 and described in further detail below.

Mounted optionally to either side of divider 53 are LED light strips 59 and 59' that contain a plurality of high output LEDs. Further, in some embodiments, a plurality of light strips 59 and 59' may be mounted to either or both sides of divider 53. In some embodiments, strips 59 and 59' comprise a ribbon which may be a semi-flexible material, such that the ribbon defines a substrate or backing for the LEDs. In some embodiments, mounted to the ribbon are a plurality of LEDs and resistors. Additionally, in some embodiments, strips 59 and 59' may have integrated circuitry such that the LEDs and resistors can be wired together, either in series or parallel, depending on the desired configuration and power requirements. In yet other embodiments, LED strips 59 and 59' may be integrated into and coextensive with divider 53, such that divider 53 defines the ribbon or substrate to which LEDs are mounted.

FIG. 6 is a cross-sectional view of one embodiment of divider 53 (or divider 3). In some embodiments, divider 53 may have an "I-beam" shaped cross-section wherein the thickness of divider 53 is slightly narrowed at the center of the cross-section. This "I-beam" shaped cross-section delimits channels 61 and 61' along the length of both sides of divider 53, wherein the channels are adapted to receive light strips 59 and 59' thereon. Further, divider 53 may have a plurality of fins 62 running lengthwise along divider 53, which provide for heat dissipation. In this sense, divider 53 functions as support for light strips 59 and 59' as well as a heat sink for the invention as a whole. It should be understood that the configuration of divider 53 as shown in FIG. 6 is capable of being used in either of the embodiments of the present invention shown in FIG. 1 and FIG. 5.

In some embodiments, strips 59 and 59' may be secured to channels 61 and 61' (and therefore divider 53) by compression fit or by an adhesive material. If a compression fit is used, it may be preferable that the cross section of the divider at channels 61 and 61' is notched or lipped such that the sides of the channels are capable of receiving the edges of strips 59 and 59', thus securing the ribbon in the channel. The use of this type of a lipped channel allows for strips 59 and 59' to be interchanged, replaced, and/or repaired as desired without damaging divider 53. As stated, in some embodiments an adhesive may be used to affix strips 59 and 59' to divider 53. Such adhesives may include, but are not limited to, epoxy, super glue, and the like.

With reference again to FIG. 5, disposed at either end of the housing 51 is a first end cap 550 that functions as a positive terminal (i.e. "+" lamp base); accordingly, disposed at the other end of the housing 51 is a second end cap 550' that functions as a negative terminal (i.e. "–" lamp base) in one embodiment, the two end caps are adapted to couple to existing high-out fluorescent light sockets for adaptability and compatibility with common lighting systems. The end caps are adapted to encase a plurality of electrical components defining an electrical terminal, described below. In an alternative embodiment, a single end cap 550 or '550 may include both the positive and negative terminals and the opposing end cap is simply a "dummy" which is not in electrical contact with the LEDs. Accordingly, the positive and negative terminals of the one or more LEDs are in electrical contact with the respective positive and negative terminals of the dual-terminal end cap.

Insulating stopper 556 (and 556') is disposed at the end of, and is received by, housing 51. Stopper 556 (and 556') may have a recess that is adapted to receive the end of divider 53, thus securing divider 53 within housing 51. In some embodiments, stopper 556 (and 556') is comprised of rubber or another like insulator. Terminal disc 555 (and 555') comprises a disc portion with power leads attached thereto. The leads are inserted through one or more apertures of stopper 556 (and 556') such that the disc portion of terminal disc 555 (and 555') rests against the end of stopper 556 (and 556'). The leads are accordingly placed in electrical contact with strips 59 and/or 59'. Next, contact disc 554 (and 554') is placed over and in electrical contact with the disc portion of terminal disc 555 (and 555'), delimiting a substantially flat surface thereon.

Spring assembly 553 (and 553') comprises a proximal spring portion and a distal pronged portion wherein the spring comprises an electrically conductive material that is in physical and electrical contact with the pronged portion at one end, and with contact disc 554 (and 554') at the other end. Accordingly, the substantially flat surface of contact disc 554 (and 554') provides for optimal physical and electrical coupling between the spring portion of the spring assembly 553 (and 553') and terminal disc 555 (and 555').

Socket base 552 (and 552') has two female prongs cavities adapted to receive the pronged portion of spring assembly 553 (and 553') in order to support the relatively flexible prongs thereof. Optionally, high output adapter 551 (and 551') may be placed over socket base 552 (and 552') such that the electrical terminal is compatible with the geometry of known high-output light sockets. Finally, end cap 550 (and 550') is adapted to encase the components of the electrical terminal. Accordingly, in use, a power supply PS (described in detail below) provides electrical energy to the high-output sockets 57 and 57' of the lighting socket, which energy travels across the high output adapter, into the socket base, through the prongs of the spring assembly, across the spring, through the contact disc and to the terminal disc and, therefore, to the LED strip.

In the foregoing embodiment, the spring assembly-contact disc arrangement defines a spring engagement between the socket (i.e. socket) and the lighting system which allows the lighting system (i.e. housing 51 containing divider 53 and strips 59 and 59') to rotate freely when it is installed in a socket. The rotational capabilities permits the lighting system to be oriented as desired, and also reduces or eliminates physical stress between the socket and the ends of the lighting system during installation, adjustment, repair, and/or replacement. The ability to rotate is a feature that is simply not available in traditional fluorescent systems, which utilize static fixtures, leading to component failure and/or the risk of injury or property damage.

As is well known in the art, standard fluorescent lighting systems are typically powered by a ballast system in order to regulate the flow of electrical power to the fluorescent bulbs. However, because LEDs operate under different conditions than a fluorescent bulb (typically, LEDs run on direct current (DC)), ballast power generally will not be needed. Accordingly, some embodiments of the present invention may also comprise a power source such as a power supply which is used as a transformer/rectifier in order to properly power the LED lighting system of the present invention. In some embodiments, it is intended that the power supply replace the ballast systems in traditional fluorescent lighting systems. In other embodiments, the light sockets themselves may be "hardwired" to a power grid (i.e. a building's electrical infrastructure) such that it will provide optimum voltage to the LED lighting system of the present invention. Accordingly, the positive and negative terminals of the power supply are connected to the respective positive and negative terminals of the powered socket system. Power is supplied to the terminals, through to the end caps, and in turn, to the appropriate terminals on the LED strip. In some embodiments, power supply may be capable of accepting and converting 120V AC power (the "input voltage") to the appropriate DC power. In other embodiments, the acceptable input voltage may range from 50V AC up to 270V AC, depending on the particular application. In yet other embodiments, a 24 Volt power supply may be used wherein the power supply includes a transformer/rectifier in order to properly power the LED strip. In some embodiments, the 24 Volt power supply is intended to replace high-out ballast that are typically used for high-output sign lamps.

For purposes of this disclosure, the size and shape of the component parts of the present invention as shown in the figures should not be construed as limiting. Furthermore, the materials selected for the component parts should also not be construed as limiting. For example, it may be desired to utilize a metal material, such as aluminum, for the divider in to allow for heat dissipation. However, a plastic (transparent or opaque) or other material may be equally well-suited. Furthermore, the end caps and other components shown in FIGS. 3, 4, and 5 may be comprised of aluminum, brass, plastic, or other known materials.

In the foregoing description, the present invention has been described with reference to specific exemplary embodiments thereof. It will be apparent to those skilled in the art that a person understanding this invention may conceive of changes or other embodiments or variations, which utilize the principles of this invention without departing from the broader spirit and scope of the invention. The specification and drawings are, therefore, to be regarded in an illustrative rather than a restrictive sense.

I claim:

1. An LED lighting system, comprising;

a housing;

a divider said divider, defining a first side and a second side, said first side having a first channel defined therein and said second side having a second channel defined therein;

one or more LED strips including one or more light emitting diodes;

one or more end caps each having at least one electrical terminal;

wherein said divider is disposed in said housing;

wherein said one or more LED strips is disposed on said first channel of said divider;

wherein an additional one of said one or more LED strips is disposed on said second channel of said divider; and wherein said electrical terminal of said one or more end caps is in electrical contact with said one or more LED strips.

2. The lighting system of claim 1, wherein said one or more end caps is adapted to engage a light socket.

3. The lighting system of claim 2, wherein said electrical terminal of said one or more end caps is disposed between and in electrical contact with said one or more LED strips and said light socket.

4. The lighting system of claim 3, wherein said light socket is in electrical contact with an electrical power source.

5. The lighting system of claim 3, wherein said electrical terminal defines a spring engagement between said one or more end caps and said light socket.

6. The lighting system of claim 5, wherein said spring engagement permits said lighting system to rotate with respect to said socket.

7. The lighting system of claim 1, wherein said divider is comprised of aluminum.

8. The lighting system of claim 1, wherein a cross section of said divider is I-beam shaped.

9. The lighting system of claim 1, wherein said divider includes one or more fins longitudinally disposed along a length of said divider.

10. The lighting system of claim 1, wherein said housing is translucent.

11. The lighting system of claim 1, wherein said housing is substantially cylindrical.

12. An LED lighting system, comprising:

a housing;

a divider said divider defining a first side and a second side, said first side having a first channel defined therein and said second side having a second channel defined therein;

one or more light emitting diodes disposed within said first channel of said divider;

one or more light emitting diodes disposed within said second channel of said divider one or more end caps each having at least one electrical terminal;

wherein said divider is disposed in said housing; and wherein said electrical terminal of said one or more end caps is in electrical contact with said one or more light emitting diodes.

13. The lighting system of claim 12, wherein said one or more end caps is adapted to engage a light socket.

14. The lighting system of claim 13, wherein said electrical terminal of said one or more end caps is disposed between and in electrical contact with said one or more light emitting diodes and said light socket.

15. The lighting system of claim 14, wherein said electrical terminal defines a spring engagement between said one or more end caps and said light socket.

16. The lighting system of claim 15, wherein said spring engagement permits said lighting system to rotate with respect to said socket.

* * * * *